United States Patent [19]

Rowley et al.

[11] 4,278,138

[45] Jul. 14, 1981

[54] COMPOSITE HEAVY METAL DRILL COLLAR

[75] Inventors: David S. Rowley; James T. Aumann; Lothar H. Waldes, all of Salt Lake City, Utah

[73] Assignee: Christensen, Inc., Salt Lake City, Utah

[21] Appl. No.: 113,497

[22] Filed: Jan. 21, 1980

[51] Int. Cl.[3] ..... E21B 17/16; F16L 9/14

[52] U.S. Cl. ..... 175/320; 285/55; 285/332; 285/422

[58] Field of Search ..... 175/320, 325; 285/55, 285/332, 422, 355, 390

[56] References Cited

U.S. PATENT DOCUMENTS

| | | | |
|---|---|---|---|
| 1,792,941 | 2/1931 | Stevenson | 285/55 |
| 2,958,512 | 11/1980 | Humphrey | 175/320X |
| 3,047,313 | 7/1962 | Bruce | 175/320 UX |
| 3,167,137 | 1/1965 | Humphrey | 175/320 |
| 3,195,927 | 7/1965 | Kimbrell | 285/55 X |
| 3,232,638 | 2/1966 | Hollander | 175/320 X |
| 3,572,771 | 3/1971 | Redwine | 175/320 X |
| 3,706,348 | 12/1972 | Murphey, Jr. | 175/320 |
| 3,955,835 | 5/1976 | Farrington | 285/332 X |

*Primary Examiner*—Stephen J. Novosad
*Attorney, Agent, or Firm*—Subkow and Kriegel

[57] ABSTRACT

A composite drill collar for drilling bore holes in earth formations including a structural steel outer jacket having a lower end secured to a lower coupling connectable to a drill bit and an upper end secured to an upper coupling connectable to an adjacent drill collar thereabove. An annular heavy metal core of sintered tungsten is disposed in the jacket and is held in compression therein by preloading the lower and upper couplings against the ends of the core, which places the jacket in tension, causing the jacket to contract and grip the periphery of the core. The structural steel jacket has a thick wall to carry the bending, torsion, compression, tension and impact loads encountered in the drilling operation, so that such loads are not carried through the core, which has the purpose of increasing the overall density and mass of the composite drill collar, lessening considerably the tendency for a deviated well bore to be produced.

9 Claims, 3 Drawing Figures

COMPOSITE HEAVY METAL DRILL COLLAR

Figure 1:
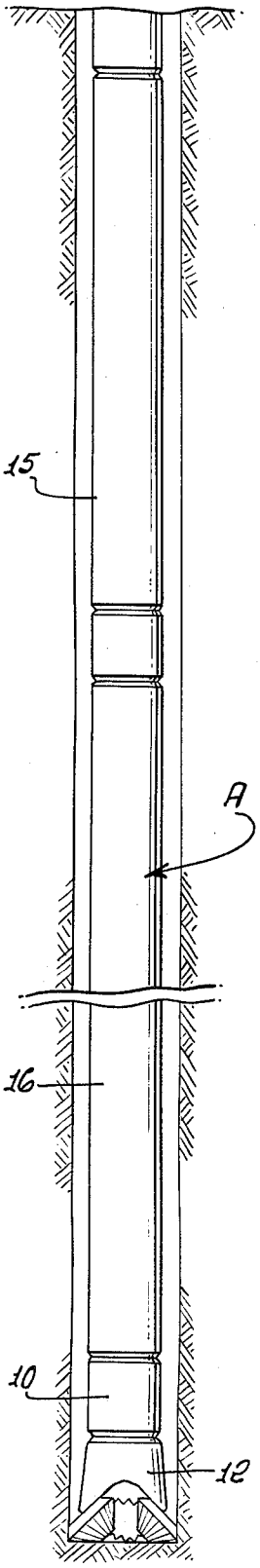

The present invention relates to subsurface apparatus for drilling oil, gas and similar well bores or bore holes in earth formations, and more particularly to heavy metal drill collars adapted to be incorporated in drill strings connected to drill bits.

Heavy metal drill collars that have an average density greatly exceeding that of steel have been proposed for incorporation in a drill pipe string to prevent the tendency of the drill bit to drill a bore hole deviating from a desired path. Such collars are disclosed in U.S. Pat. Nos. 2,958,512; 3,047,313; 3,167,137 and 3,706,348, all of which include an annular chamber within a steel outer jacket containing a metal having a density much greater than that of steel. In U.S. Pat. Nos. 2,958,512 and 3,167,137, the chambers are filled with lead or a lead alloy. Such metals have a number of disadvantages, including insufficient specific gravity greater than steel, relatively ready deformability under the impact loads to which the apparatus is subjected during the rotary drilling of the bore holes, a tendency to be displaced and pack into the threaded connections at the upper and lower ends of the outer jacket, and relatively short life.

In U.S. Pat. No. 3,047,313, the annular chamber is filled with lead, mercury, tungsten, osmium or uranium. If tungsten or uranium is used, such materials are brittle and will break off readily, particularly since they are subject to impact or shock loads encountered during the drilling operation. The life of the drill collar is relatively short, since it will fail from fatigue.

In U.S. Pat. Nos. 2,958,512; 3,047,313 and 3,167,137, the heavy metal in the steel shell is not held therein rigidly and does not contribute to the structural strength of the drill collar. The only function of the heavy metal is to add more weight to the composite drill collar.

In U.S. Pat. No. 3,706,348, a heavy metal structure has its lower end coupled to a connector secured to a drill bit and its upper end coupled to a connector secured to a drill collar thereabove. The drilling torque and drilling weight are transmitted from the upper connector directly through the heavy metal structure to the lower connector, which subjects the heavy metal to bending, torsion, compression, tension and impact loads. The heavy metal in this patent is stated to be extruded depleted uranium or sintered tungsten, which are brittle materials, and which will break off due to repeated impact loads to which the drill collar is subjected during the rotary driling operation. The threaded connections provided between the upper and lower connectors and the heavy metal structure are a source of fatigue failure because of the brittle characteristics of the tungsten and uranium. The heavy metal structure disclosed in U.S. Pat. No. 3,706,348 is incapable of safely withstanding shock loads, resulting in relatively early failure of the weighted drill collar.

In accordance with the present invention, the composite drill collar consists of a thick-walled shell or jacket, such as a high strength steel member, enclosing a heavy metal tubular core, such as sintered tungsten, which is preloaded in endwise compression within the jacket which is placed in tension and contracted to grip the periphery of the core. Such compressed state not only causes the core and jacket to move together as a unit during the drilling of a bore hole, but insures the resistance of the unit to deflection. Moreover, it insures the retention of the compressed state of the core when the composite heavy metal drill collar is subject to temperature changes, such as encountered in geothermally heated formations. In the event the core is made of sintered tungsten, the core will retain a tight fit with the inner wall of the shell. The core expands less than the thick-walled shell, since the linear coefficient of thermal expansion of the core is less than that of the steel shell, the preload tension in the jacket causing it to remain contracted against the core, which remains under compression. Because the compressive strength of the tungsten core is greater than its tensile strength, the core will have less tendency to crack in compression, resulting in a much greater core and collar life.

The thick-walled steel outer jacket or shell is capable of transmitting substantially all of the bending, torsion, compression and impact loads that are imposed on the collar during the drilling operation. Substantially all of such loads are transmitted through the jacket, and not through the heavy metal core, which is made of relatively brittle material, and which would tend to break off and suffer early fatigue failure in the event that loads other than compressive loads were imposed upon it.

Accordingly, it is an object of the present invention to provide a composite heavy metal drill collar having a thick-walled shell or jacket and a heavy core, the heavy core being maintained in endwise compression, and the thick-walled shell transmitting substantially all of the various loads that are imposed upon the drill collar.

Another object of the invention is to provide a composite heavy metal drill collar in which the heavy metal core is secured within a thick-walled jacket or shell under endwise compression, and in which substantially none of the drilling torque and drilling weight, other than the weight of the core, is transmitted through the core to the drill bit secured to the lower end of the drill collar, the core remaining under compression and fixed with respect to the thick-walled shell or jacket, despite variations in the temperature of the well bore in which the drill collar is disposed.

This invention possesses many other advantages, and has other objects which may be made more clearly apparent from a consideration of a specific form in which it may be embodied, this form being shown in the drawings accompanying and forming part of the present specification. It will now be described in detail, for the purpose of illustrating the general principles of the invention, but it is to be understood that such detailed description is not to be taken in a limiting sense.

Figure 2A:
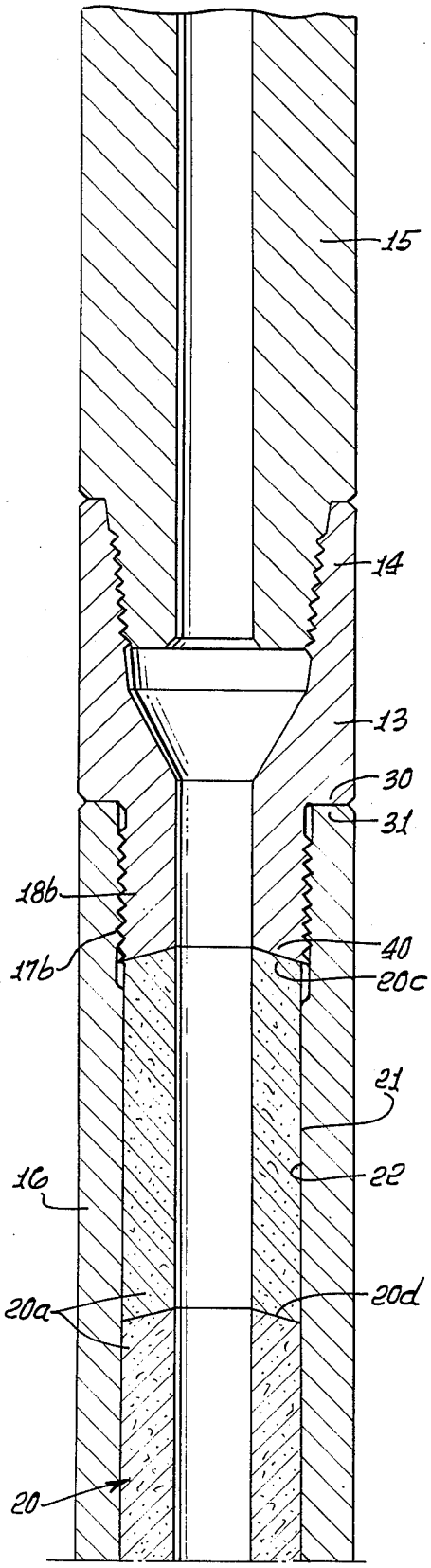
Figure 2B:
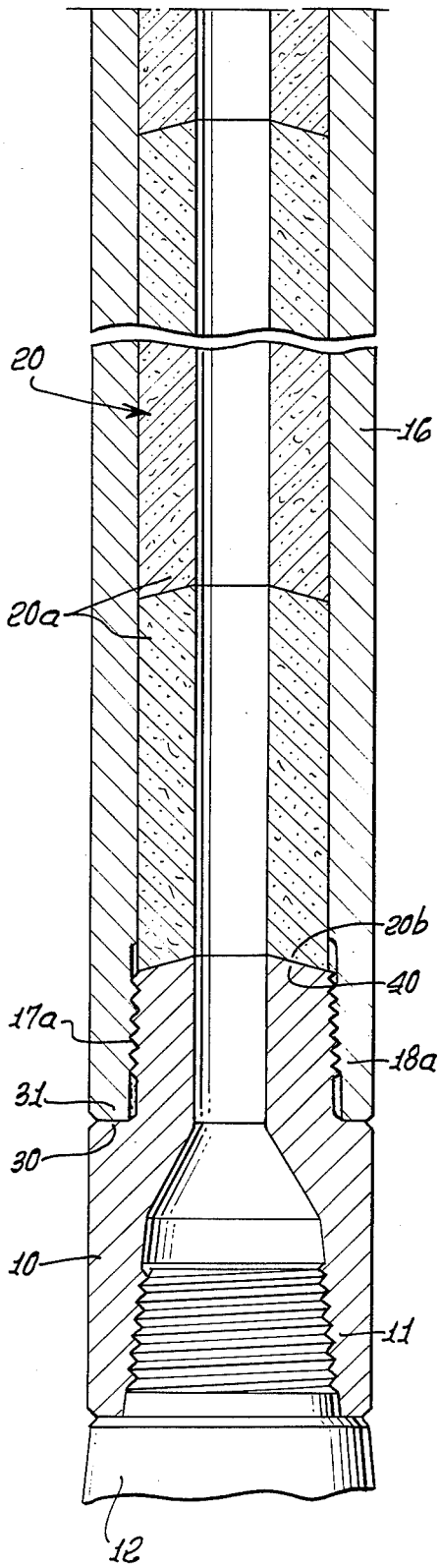

Referring to the drawings:

FIG. 1 is a side elevational view of a drill collar string embodying the invention and a drill bit attached thereto, all disposed in a well bore; and FIGS. 2*a* and 2*b* together constitute an enlarged longitudinal section through a portion of the drill collar string shown in FIG. 1, FIG. 2*b* being a lower continuation of FIG. 2*a*.

As illustrated in the drawings, a heavy metal drill collar assembly A is connected to an upper collar 15 and to a lower drill bit 12. A lower bit sub or connector 10 has a threaded box 11 for attachment to the drill bit 12, an upper sub or connector 13 having a threaded box 14 for attachment to the adjacent upper drill collar 15. A thick-walled tubular jacket or shell 16 of a suitable length, such as about 18 feet, is positioned between the two subs 10, 13, each end of the jacket being provided with a straight female thread 17*a*, 17*b* for threaded attachment to a companion pin 18*a*, 18*b* of the adjacent sub 10, 13. A heavy metal tubular core 20 is disposed within the jacket 16 and extends therein the full distance between the subs, the outer surface 21 of this core engaging the inner wall 22 of the jacket.

The core may be made in one piece, but preferably of a plurality of segments 20*a* abutting one another. The tapered ends 20*b*, 20*c* of the end segments are adapted to be engaged by the companion tapered inner ends 40 of the upper and lower subs 13, 10. The core is rigid and can be made of sintered tungsten, extruded depleted uranium, or other heavy material to increase the density and weight of the composite structure. The sintered tungsten can be composed of about 95% tungsten and about 5% of a binder material of cobalt, nickel, copper and manganese. The core is placed under compression by first inserting the core segments in the jacket and threading the upper and lower subs 13, 10 into the jacket until the inner ends 40 of the subs engage the upper and lower ends 20*c*, 20*b* of the core. Torque is then applied to the subs to preload the core 20 therebetween in compression, the amount of compression being limited by engagement of transverse shoulders 30 on the subs with companion transverse ends 31 of the jacket.

As the subs are tightened against the ends of the core, to apply endwise compression preload to the core, the threading of the subs in the jacket reactively places the jacket 16 in tension, causing it to contract and its inner wall 22 to frictionally grip the periphery 21 of the core, which initially has a diameter only slightly less than the internal diameter of the jacket or shell. The contraction of the jacket against the core further compresses the latter.

It is to be noted that the inner ends 40 of the subs 13, 10 or connector members are tapered, engaging companion tapered ends 20*b*, 20*c* of the heavy metal core or core segments. Such tapered engagement serves to center the core and its segments in the jacket. When the core is made of several segments 20*a*, abutting ends 20*d* of adjacent segments are also tapered, in order to center the segments with respect to one another.

Depleted uranium alloy has a specific gravity of about 18.4, as compared to a specific gravity of about 7.8 for alloy steel, from which the outer jacket or shell 16 is made. Sintered tungsten has a specific gravity of about 17.0. Both the sintered tungsten and the depleted uranium alloy have a specific gravity more than twice that of steel, enabling a much greater weight to be placed in the drilling string immediately above the drill bit, to utilize the pendulum effect of the concentrated heavier load adjacent the bit to prevent the latter from deviating from a desired drilling path in drilling the bore hole.

The heavy metal drill collar A is essentially different from other heavy collar concepts in that the jacket 16 itself has a thick wall containing the heavy core 20, the jacket providing the structural integrity of the composite member, while the heavy core provides the concentrated weight. As an example, a 9" O.D. jacket with a 6" I.D. inner wall receives a weighted core having a $2\frac{3}{4}$" diameter passage. Thus, the steel jacket has a $1\frac{1}{2}$" wall thickness. With a composite collar of such dimensions, a tension preload can be placed on the jacket of about 74,000 psi and a compression preload on the core of about 110,000 psi. The steel jacket carries the bending, torsion, compression, tension and impact loads transmitted between the upper collar 15 and the drill bit 12, the heavy metal core of depleted uranium or sintered tungsten providing the increase in the density and weight of the composite structure A, without requiring the core 16 to carry any of the structural loads. This combination greatly enhances the reliability and strength of the composite heavy metal drill collar.

In the event the composite collar is used in geothermally heated formations, known as "hot holes", the temperature of the collar will rise as it is lowered in the bore hole. In the case of depleted uranium, its linear coefficient of thermal expansion is about $9\times10^{-6}$ inches per inch per degree F., whereas 4140 steel has a linear coefficient of thermal expansion of $5.6\times10^{-6}$ inches per inch per degree F. Thus, with rise in temperature of the entire collar, and in view of the greater linear coefficient of thermal expansion of uranium, the compressive force imposed by the steel jacket on the depleted uranium core will actually increase. Although depleted uranium is a relatively brittle material, there will be lessened tendency for the increased compression imposed on the core to crack it, since such core is much stronger in compression to which it is subjected than the tensile strength of the core. Accordingly, the composite collar is structurally superior to a threaded core, as disclosed in U.S. Pat. No. 3,706,348.

In the event that the core is made of sintered tungsten, which has been secured within the steel jacket and preloaded in compression, the use of the collar in geothermally heated formations will reduce the compressive force on the tungsten core, since the linear coefficient of thermal expansion of tungsten is less than that of steel. Nevertheless, the relative expansion of the steel jacket with respect to the tungsten core will be insufficient to release the core from its compressed state against the wall of the steel jacket. The sintered tungsten core will still be held in compression during the operating life of the drill collar. Additionally, the jacket and core combination functions as a single unit, producing a greater resistance to deflection than the jacket alone.

We claim:

1. A composite drill collar adapted to form part of a drill pipe string used in drilling a bore hole in earth formations, comprising an elongate outer pipe member, upper connector means adapted to secure the upper end of said outer pipe member to an adjacent drill pipe member thereabove, lower connector means adapted to secure the lower end of said pipe member to a drill bit therebelow, a rigid elongate annular member in said outer pipe member having a specific gravity at least twice the specific gravity of said outer pipe member, said annular member being in a solid state when placed in said outer pipe member, means for preloading said annular member in axial compression within said outer pipe member before the composite drill collar is lowered in the bore hole, said outer pipe member having sufficient wall thickness whereby substantially all bending, torsion, compression, tension and impact loads are transmitted from the adjacent drill pipe member thereabove through said outer pipe member to the drill bit without being imposed on said annular member.

2. A composite drill collar adapted to form part of a drill pipe string used in drilling a bore hole in earth formations, comprising an elongate outer pipe member, upper connector means adapted to secure the upper end of said outer pipe member to an adjacent drill pipe member thereabove, lower connector means adapted to secure the lower end of said outer pipe member to a drill bit therebelow, a rigid elongate annular member in said outer pipe member having a specific gravity at least twice the specific gravity of said outer pipe member, means for preloading said annular member in axial compression within said outer pipe member to reactively place said outer pipe member in tension and in contracted condition with its inner wall frictionally engaging the periphery of said annular member along substantially the entire length of said member, said outer pipe member having sufficient wall thickness whereby substantially all bending, torsion, compression, tension and impact loads are transmitted from the adjacent drill pipe member thereabove through said outer pipe member to the drill bit without being imposed on said annular member.

3. A composite drill collar as defined in claim 1 or 2; said preloading means comprising means for moving said upper and lower connector means toward one another and against the ends of said annular member.

4. A composite drill collar as defined in claim 1 or 2; said preloading means comprising a lower threaded connection between said lower connector means and said outer pipe member, and an upper threaded connection between said upper connector means and said outer pipe member, whereby threading of said connectors with respect to said outer pipe member and toward each other engages said connectors with the ends of said annular member and applies an axial compressive preload thereto.

5. A composite drill collar as defined in claim 4; and stop means on said connectors engaging opposite ends of said pipe member to limit the extent of threading of said connectors with respect to said outer pipe member.

6. A composite drill collar as defined in claim 5; said upper and lower connectors having tapered inner ends engaging companion tapered upper and lower ends of said annular member to center said annular member in said outer pipe member.

7. A composite drill collar as defined in claim 1 or 2; said outer pipe member being made of steel.

8. A composite drill collar as defined in claims 1, 2, or 4; said annular member being depleted uranium.

9. A composite drill collar as defined in claims 1, 2, or 5; said annular member being sintered tungsten.

* * * * *